United States Patent [19]

Bruer

[11] Patent Number: 4,613,255

[45] Date of Patent: Sep. 23, 1986

[54] EMBANKMENT STABILIZING BRICK

[76] Inventor: Manfred Bruer, Postfach 63 12 27, D-6204 Taunusstein 1, Fed. Rep. of Germany

[21] Appl. No.: 601,383

[22] Filed: Apr. 17, 1984

[30] Foreign Application Priority Data

Apr. 18, 1983 [DE] Fed. Rep. of Germany ..... 3313990

[51] Int. Cl.[4] ..... E02D 29/02

[52] U.S. Cl. ..... 405/286; 52/610; 404/34; 405/284

[58] Field of Search ..... 405/284–287; 52/609, 610; 404/34, 40, 41

[56] References Cited

U.S. PATENT DOCUMENTS

| | | | |
|---|---|---|---|
| 790,436 | 5/1905 | Inman | 52/610 |
| 1,422,551 | 7/1922 | Fletcher | 404/34 |
| 2,185,497 | 1/1940 | Cilento et al. | 52/610 X |
| 2,215,159 | 9/1940 | Rothmann | 404/34 |
| 3,323,266 | 6/1967 | Dalkas | 52/610 X |
| 4,426,176 | 1/1984 | Terada | 52/610 X |

FOREIGN PATENT DOCUMENTS

| | | | |
|---|---|---|---|
| 1163080 | 4/1958 | France | 52/610 |
| 637630 | 4/1962 | Italy | 52/610 |

*Primary Examiner*—Dennis L. Taylor

*Attorney, Agent, or Firm*—Balogh, Osann, Kramer, Dvorak, Genova & Traub

[57] ABSTRACT

The embankment stabilizing brick, in plan view, is of an L-shaped configuration. Formed on the free end of the short-ended leg (12 ) is a stub tongue (14) extending in the direction of the long-ended leg. The length of the stub tongue corresponds at least to about half the width of the long-ended leg (10) but amounts only to a fraction of the length thereof. Provided on the upper and lower sides are depressions (16, 18) serving for mutually keying superposed embankment stabilizing bricks. The weight of the new brick corresponds to almost half the weight of conventional embankment stabilizing bricks; however, owing to the stub tongue (14) it can be stably stored superposed in various positions.

5 Claims, 2 Drawing Figures

EMBANKMENT STABILIZING BRICK

Figures 1, 2:
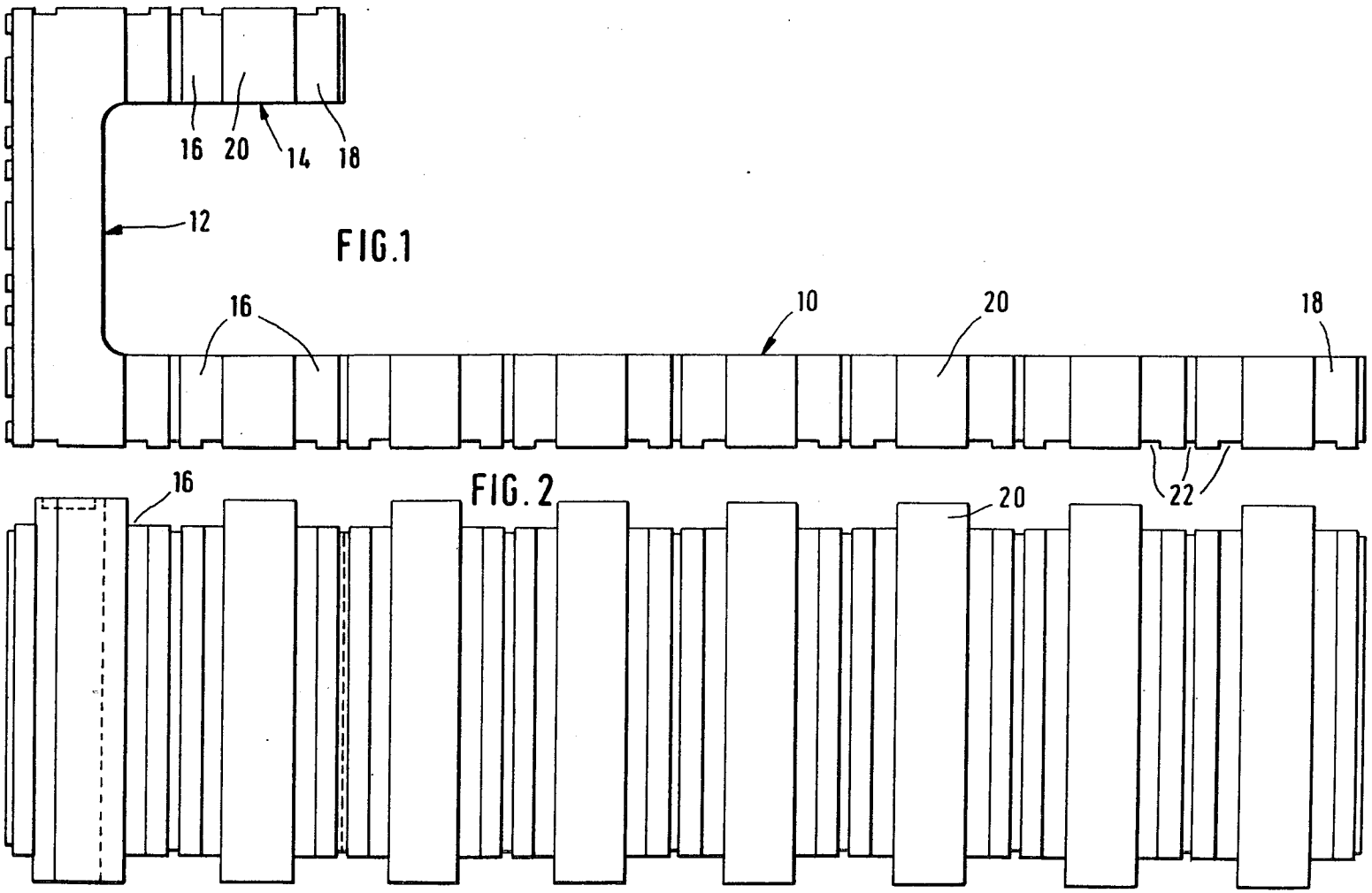

Embankment stabilizing bricks are intended to stabilize the soil of embankments for which reason, the shaping thereof should be such that they can be mutually brought into form-locking engagement. Further requirements reside in that the bricks with embankments of different degrees of steepness and curvature be suitable for versatile and varied use, at the same time being able to catch their claws in the soil. In the light of the high efforts in terms of material and work expended during laying, a light weight of the bricks usually made of concrete is desirable nevertheless safeguarding adequate strength and safety against fracture while permitting a maximum possible length. As the wall strength cannot be reduced below a predetermined minimum value, shaping is the more so important. The usual forms, in plan view, are of a U-shaped configuration or closed per se rectangular frames the interior spaces of which, in laid condition, are filled with soil. Owing to the three or even four wall sides, the prior art embankment stabilizing bricks either are of a relatively short length or of a relatively heavy weight. With a weight of e.g. 130 kg for bricks about 1 m long, a crane will already be required for laying work. Bricks of a shorter length will envolve more extended working times. Moreover, they cannot be anchored deeply enough in the soil.

It is the object of the present invention, to provide an embankment stabilizing brick complying with the requirements placed upon it and having a minimized weight. This problem, in accordance with the invention, will be solved in that the brick, in plan view, is of a substantially L-shaped configuration and comprises a stub tongue formed on the free end of the short-ended leg and substantially extending in the direction of the long-ended leg, the length of which corresponds at least to about half the width of the long-ended leg at least in the area of predetermined bearing points, but amounts only to a fraction of the length thereof.

The new embankment stabilizing brick, with an identical length, only has half the weight of the conventional frame-type brick. With a weight of as little as 69 kg rather than 130 kg, a worker, hence, will be able to lay it without requiring the assistance of a crane, thereby substantially accelerating the laying work and bringing down the costs envolved therewith. Further advantages attained are material savings of almost 50%, a correspondingly reduced space requirement and reduced transport weights for storage and all transports.

Although almost half the frame of the prior art rectangular embankment stabilizing brick has been eliminated, the fields of application of the new brick, by no means are restricted. The opposite is rather true, for, on the one hand, the stub tongue will safeguard stable mounting of a brick on a brick therebelow and, on the other hand, occasionally even a plurality of bricks with the long-ended legs thereof, in parallel condition, may be closely laid in side-by-side relationship. Filling up of the interspaces between bricks in hooked engagement with one another, even under difficult conditions, will be easier and more reliable because the bricks may be superposed in layers to form structures having relatively large interior free spaces. Only unnecessary wall areas have been eliminated which, when filling up said interspaces of the reticular structure of the embankment stabilizing bricks in engagement with one another, may be disturbing.

To attain a safe form-lock between the bricks in a multiplicity of laying possibilities, according to a preferred embodiment of the invention, at least the long-ended leg is provided with depressions extending crosswise of its top and bottom sides, the width of which, measured in the longitudinal direction, is larger than its width at least in the area of predetermined bearing points. According to this embodiment, embankment stabilizing bricks crosswise superposed, mutually, can be blocked in as many positions as permitted by the various combinations of depressions to be brought into engagement. No difficulties are envolved, according to another preferred embodiment of the invention, to adjust the space of the stub tongue from the long-ended leg to the spaces between the depressions in a manner that with two identical bricks superposed in transverse direction, both the long-ended leg and the stub tongue of the upper brick will get into engagement with depressions of the lower brick.

The new embankment stabilizing brick will already comply with the requirements placed upon it if the stub tongue offers but one bearing possibility to another brick; for this, it need not even have a length corresponding to the width of the wall in the bearing area. However, if it is desired to offer to the garden and landscape architect further bearing possibilities, the stub tongue can be extended such that in the structural module of the depressions in the surface of the long-ended leg, two depressions can be provided thereon that are in alignment with the innermost depressions in the long-ended leg. The outer one of the two depressions on the upper and lower sides of the stub tongue need not even be of the full width of the rest of the depressions, for, a bearing face of smaller width at the free end will also be adequate for a safe support of another brick. The same applies to the free end of the long-sided leg. By using such cut-off, e.g. bisected depressions quasi open on one side at the free ends of the brick the weight can be further reduced in a given number of laying possibilities.

Alignment of the depressions in the stub tongue with the innermost depressions in the long-ended leg will safeguard that embankment stabilizing bricks crosswise superposed are reliably locked not only against tearing-apart of the brick but also against twisting thereof. Moreover, advantages of manufacture are envolved, as the aligning depressions in the shaping of the bricks can be provided by continuous form strips.

In a preferred practical form of embodiment, the outer and/or inner side faces of the embankment bricks are provided with perpendicular grooves improving the earth leakage and causing efflorescence to have a less disturbing outward appearance.

The invention will now be described in greater detail with reference to the drawing wherein FIG. 1 shows a plan view and FIG. 2 a side view of the new embankment stabilizing brick.

The plan view of the embankment stabilizing brick discloses the L-shaped configuration thereof. The long-ended leg has been designated by reference numeral 10 and the short-ended leg by numeral 12. Provided at the free end of the latter is an axial stub designated by 14 which extends in parallel to long-ended leg 10 but has only a fraction of the length thereof of about 1 m. Deducting the width of the short-ended leg 12 amounting to e.g. 7.5 cm, as does the width of the long-ended leg, stub tongue 14, in the case of example, has a length of as little as 17.5 cm, hence being already longer than would be absolutely required, for, in order to offer to another brick a stable support, theoretically, a length of only half the width of the long-ended leg 10 would be adequate.

To cause several embankment stabilizing bricks to engage by mutual keying, the bricks on the upper and lower sides thereof are provided with depressions 16. Such depressions extend crosswise of the long-ended leg 10 and stub tongue 14. Provided respectively at the free end thereof is a quasi cut-off depression of half the width which, in the drawing, is designated by 18. Depressions 16 are a few millimeters wider than the wall thickness of the brick. If the aligning depressions 16 in stub tongue 14 and in the long-ended leg 10 are of a width of, for example, 78 mm, the long-ended leg 10 of another identical brick can be inserted at any desired point into the said aligning depressions 16. Preferably, the width of the embankment stabilizing brick, measured from the outer side wall face of the long-ended leg 10 to the outer side wall face of the stub tongue 14—which in the exemplary case is 32.5 cm—is so selected that, with crosswise superposed bricks the stub tongue 14 and the long-ended leg 10 engage various depressions 16 of the respectively other brick. In the position of engagement, the lateral boundary faces of the depressions of the one brick protect against relative displacement in the one direction, and the lateral boundary faces of the depressions of the other brick protect against a relative displacement in a direction at right angles to said former mentioned direction.

The width of the elevations designated by 20 between depressions 16 and 16 and 18, respectively, in the case of example, uniformly amounts to 5, 1 cm.

As, moreover, shown by the drawing, the outer side faces of the embankment stabilizing brick are subdivided by perpendicular grooves 22. These grooves are located on the long-ended leg 10 and on the stub tongue 14 in the area of depressions 16 and 18, respectively. To the extent as these parts of the embankment stabilizing brick are located in the soil, an improved claw catching therein will be attained by the said grooves. Moreover, as a result of the grooves, efflorescence on visible surfaces will not be of a disturbing appearance.

Stub tongue 14, if need be, may be extended by one or several depressions 16. However, as this will envolve a corresponding increase in weight, preferance will be given to a stub tongue of short length as shown in the example of embodiment.

Moreover, also the short-ended leg 12, on the upper and lower sides thereof could be provided with depressions 16 located crosswise of its longitudinal extension. This would slightly increase the price for the formwork.

Finally, it will have to be pointed out that, for the production of the embankment stabilizing brick, other materials such as asbestos cement or plastic material, may be used in place of concrete, and measurements other than those referred to in the afore-going by way of example, may be selected.

I claim:

1. An embankmet stabilizing brick of essentially L-shaped configuration, in plan view, comprising a long leg and an interconnected short leg, and a longitudinally extending stub tongue formed on the free end of said short leg, said stub tongue having a length of at least half the width of the long leg but amounting only to a fraction of the length of said long leg, said long leg and said short leg having a plurality of depressed transversely extending bearing slots on upper and lower bearing surfaces thereof, the length of said slots measured in the longitudinal direction being greater than the width, the space between said stub tongue and said long leg and the spaces between said depressed bearing slots being such that with two identical bricks superposed crosswise, said slots of said long leg and said stub tongue of one brick will engage with said slots of the other brick.

2. An embankment stabilizing brick as claimed in claim 1, wherein said slots on the upper and lower bearing surfaces of said stub tongue are in alignment with corresponding slots on said long leg.

3. An embankment stabilizing brick as claimed in claim 1, wherein the free end of each of said long leg and short leg bearing surfaces includes a bearing slot having a length shorter than the width.

4. An embankment stabilizing brick as claimed in claim 1, wherein at least one of the side faces is provided with vertical grooves.

5. An embankment stabilizing brick as claimed in claim 1, characterized by a grouping arrangement wherein a long leg of one brick is positioned upon the long leg and stub tongue of another brick.

* * * * *